US012600510B2

(12) United States Patent
Heydel et al.

(10) Patent No.: US 12,600,510 B2
(45) Date of Patent: Apr. 14, 2026

(54) METHOD FOR MANUFACTURING A COMPOSTABLE POD

(71) Applicant: SOCIETE DES PRODUITS NESTLE S.A., Vevey (CH)

(72) Inventors: Christophe Sebastien Paul Heydel, Chez le Bart (CH); Camille Marie-Rose Eliane Daganaud, Pully (CH); Frederic Doleac, Vaux et Chantegrue (FR)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 18/843,343

(22) PCT Filed: Mar. 1, 2023

(86) PCT No.: PCT/EP2023/055064
§ 371 (c)(1),
(2) Date: Sep. 3, 2024

(87) PCT Pub. No.: WO2023/166001
PCT Pub. Date: Sep. 7, 2023

(65) Prior Publication Data

US 2025/0171178 A1 May 29, 2025

(30) Foreign Application Priority Data

Mar. 3, 2022 (EP) ..... 22160027

(51) Int. Cl.
*B65B 29/02* (2006.01)
*B65B 9/00* (2006.01)
(Continued)

(52) U.S. Cl.
CPC ..... *B65B 29/025* (2017.08); *B65B 9/00* (2013.01); *B65B 9/045* (2013.01); *B65B 51/225* (2013.01); *B65B 61/06* (2013.01)

(58) Field of Classification Search
None
See application file for complete search history.

(56) References Cited

U.S. PATENT DOCUMENTS 7,910,145 B2 * 3/2011 Reati ..... B65B 61/005 426/77
8,563,058 B2 * 10/2013 Roulin ..... A47J 31/407 426/77

(Continued)

FOREIGN PATENT DOCUMENTS

EP 2412645 A1 * 2/2012 ..... B65D 85/8061
WO 2020217198 10/2020

OTHER PUBLICATIONS

International Search Report for International Application No. PCT/EP2023/055064 mailed Jun. 28, 2023, 3 pages.

(Continued)

*Primary Examiner* — Tanzim Imam
(74) *Attorney, Agent, or Firm* — K&L Gates LLP

(57) ABSTRACT

The invention relates to a method for manufacturing a pod (100) for preparing a beverage in a beverage production machine, the machine having opening elements for opening the pod (100) under the effect of rising pressure of fluid being injected into the pod (100). In the method, two formable sheet elements (200) are provided, into one of which an opening (210) is cut. A second sheet material (300) is provided and connected with the respective sheet element (200) at a connection area (230) that circumferentially surrounds the opening (210). The so connected sheet material (300) forms a delivery wall (110) of the pod (100), through which during the beverage preparation process the (Continued)

prepared beverage is dispensed from the pod (100). The two sheet elements (200) are formed into the shape of a half-shell (101, 102), respectively, whereby the connection area (230) is pinched from opposite sides of the sheet element (200) when forming the respective half-shell (101, 102). An injection wall (120) for injecting a fluid into the pod (100) is formed. A substance (105) for the beverage is provided and the two half-shells (101, 102) are connected to form a pod body (130) around the substance (105). Therein, the pod body (130) together with the delivery wall (110) and the injection wall (120) delimit a chamber containing the substance (105). The delivery wall (110) is configured to be opened upon interaction with the opening elements of the beverage production machine under the effect of rising pressure of the fluid being injected into the pod (100).

17 Claims, 3 Drawing Sheets

(51) Int. Cl.

| | |
|---|---|
| ***B65B 9/04*** | (2006.01) |
| ***B65B 51/22*** | (2006.01) |
| ***B65B 61/06*** | (2006.01) |

(56) References Cited

U.S. PATENT DOCUMENTS

| | | | | |
|---|---|---|---|---|
| 8,950,315 | B2 * | 2/2015 | Lai | A47J 31/42 99/279 |
| 9,227,777 | B2 * | 1/2016 | Steven | A47J 31/02 |
| 10,538,380 | B2 * | 1/2020 | Talon | B65D 85/8055 |
| 2011/0117248 | A1 * | 5/2011 | Rivera | B65B 29/022 426/77 |
| 2012/0070551 | A1 * | 3/2012 | Mahlich | A23F 5/26 426/433 |
| 2014/0190863 | A1 * | 7/2014 | Fabozzi | B65B 29/022 206/524.6 |
| 2018/0370720 | A1 * | 12/2018 | Heydel | B65D 85/8052 |
| 2019/0119036 | A1 * | 4/2019 | Nordqvist | B29C 45/1642 |
| 2019/0225413 | A1 * | 7/2019 | Dogan | B65D 85/8055 |
| 2021/0300609 | A1 | 9/2021 | Magnani et al. | |
| 2022/0009704 | A1 * | 1/2022 | Dogan | B65D 85/8052 |

OTHER PUBLICATIONS

Written Opinion of the International Searching Authority for International Application No. PCT/EP2023/055064 mailed Jun. 28, 2023, 6 pages.

* cited by examiner

METHOD FOR MANUFACTURING A COMPOSTABLE POD

CROSS REFERENCE TO RELATED APPLICATIONS

The present application is a National Stage of International Application No. PCT/EP2023/055064, filed on Mar. 1, 2023, which claims priority to European Patent Application No. 22160027.3, filed on Mar. 3, 2022, the entire contents of which are being incorporated herein by reference.

1. FIELD OF THE INVENTION

The present invention relates to a method for manufacturing a pod for preparing a beverage in a beverage production machine, the pod having a wall portion that opens upon interaction with opening elements of the beverage production machine under the effect of rising pressure of a fluid being injected into the pod.

2. TECHNICAL BACKGROUND

Single-serve beverage containers for beverage preparation machines, such as capsules or pods, are known in the art. These beverage containers are commonly used for on demand dispensing of beverages, like coffee, tea or hot chocolate, and enjoy popularity due to fresh tasting, variability of flavours and convenience of the beverage preparation.

Usually, the beverage container containing a beverage component is inserted in a container holder of a beverage preparation machine, the container holder is closed and preparation of the beverage is started. Fluid, such as hot water or milk, is delivered to the beverage container to interact with the beverage component contained inside the beverage container to produce the desired beverage. When a sufficient amount of the fluid fills the beverage container, the beverage container opens under pressure of the fluid to release the prepared beverage. Opening of the beverage container can be accomplished by pressing an extraction face of the beverage container with a force effected by increasing the pressure of the fluid inside the beverage container against an opening structure provided in the container holder such that the extraction face is torn upon reaching a breaking stress. The opening structure can be a number of relief and recessed elements, e.g. pyramid-like elements, onto which the extraction face extends and tears under the effect of the internal pressure of the fluid. Such pressure controlled beverage preparation has the advantage that it can produce a beverage of high quality.

Typically, known beverage containers are made of materials, for which reusing, recycling or composting requires a challenging process, in particular after the use of the beverage container. Therein, the beverage containers can often comprise non-biodegradable plastic, e.g. polypropylene, and/or metal, e.g. Aluminium, for example.

Therefore, in the prior art, different attempts to replace these materials with biodegradable or compostable materials, such as biodegradable polymers or paper, were undertaken, which poses numerous challenges since food-packaging applications generally place high requirements on the barrier performance of the packaging in order to keep the packaged product's aromas, freshness and integrity intact over the entire intended shelf life. Moreover, it is necessary that the new materials match or even exceed the material characteristics of the established materials with respect to resistance to heat and pressure as well as to the length of the shelf life achieveable with the new packaging.

In experiments not disclosed to the public, promising results were obtained for a compostable beverage container that is made from a formable material and that has an extraction face made from a different material, which is adapted to be opened during the beverage preparation process. The formable material is used to form the container body and is provided with a cutout that is covered and connected with the material for forming the extraction face. For example, such beverage container is described in international application PCT/EP21/077158.

Unfortunately, it was found that numerous challenges exist also in developing a suitable manufacturing process for this type of beverage container that facilitates the provision of a reliable oxygen barrier at the connecting portions of the different materials. Typically, said two materials are connected to each other before being formed together into the final shape of the beverage container so strong material bonding can be ensured. However, the connection between the different materials was identified as being susceptible for breaking or tearing during the forming process. Thus, in addition to having an ineffective oxygen barrier, the finished beverage container has an increased risk of delamination or leaking before or during the beverage preparation process. A possible reason for this may be shearing forces that are generated during the forming process and that exert a stress on the connection. Therein, the shearing forces may be particularly detrimental for the bonds between the different materials and thus, cause tearing of the connection between the different portions of the beverage container. However, these circumstances are detrimental for ensuring the integrity of the product inside the beverage container and thus, shelf life is reduced. Although improvements were made by supporting the forming process by additional auxiliary measures, such as pre-wetting the formable material or by additionally applying heat and/or pressure during the forming process, the underlying problem and corresponding issues remain.

Accordingly, it is an object of the invention to provide a manufacturing process for a beverage container, such as a pod, that allows to overcome the above-mentioned drawbacks of the prior art. Also, it is an object of the invention to manufacture a compostable beverage container, which comprises a reliable and effective oxygen barrier and which has a reduced risk of leakages before or during the beverage preparation process. Moreover, it is an object of the invention to manufacture a beverage container without the need for auxiliary measures, such as pre-wetting of the formable container wall material, in order to facilitate producing the beverage container with already existing manufacturing lines and equipment.

These and other objects, which become apparent upon reading the description, are solved by the subject-matter of independent claim 1. The dependent claims refer to preferred embodiments of the invention.

3. SUMMARY OF THE INVENTION

A first aspect of the invention relates to a method for manufacturing a (compostable) pod for preparing a beverage in a beverage production machine.

Therein, a pod may be understood, for example, as a receptacle or container enclosing a volume for containing a substance required for the beverage preparation. The pod may be flat and (generally) rounded in shape, and/or may have the shape of a (circular and/or double-convex) lens. Unlike a capsule for beverage preparation (e.g. as commonly known in the art), a pod may, for example, not comprise a substantially flat top surface (which in said capsules is typically formed by a lid), but instead the pod may comprise one outwardly bulging surface on either side of the pod's content.

In the method, two sheet elements are provided, each of the sheet elements being made of a formable and preferably biodegradable material.

Therein, a sheet element may be understood, for example, as an element that may be thin in comparison to its length and breadth, and/or that may be provided from a sheet.

Further, the term "formable" may be understood, for example, as the characteristic of a material being malleable, pliable, and/or shapable, preferably with/without the support of additional tools and/or preferably with/without the application of heat and/or water. For example, in a dry pulp moulding process, a blank of dried cellulose fibres may be provided and formed with a tool into a (permanent) shape of the pod. For instance, the formable material of the pod may facilitate to provide the pod with form-stability, stiffness and/or rigidity, each of which sufficient for building up pressure inside the pod during beverage preparation.

Further, a "biodegradable material" may be understood, for example, as any material that can be broken down into environmentally innocuous products by (the action of) living things (such as microorganisms, e.g. bacteria, fungi or algae).

An opening is cut into (at least) one of the sheet elements.

Therein, the expression "opening" may be understood, for example, as an opening that may be formed by cutting matter out of a material. For example, the opening may be specified by a sharp edge defining its perimeter. For example, the opening may be a cutout or (through) hole or a perforation in the material, and/or may preferably form a passage between two opposite sides of the material, where the opening is cut.

The opening is covered with a sheet material. The sheet material and the respective sheet element are connected (preferably by heat sealing or ultrasonic sealing) at a connection area. The connection area circumferentially surrounds the opening. The so connected sheet material forms a delivery wall (in the finished pod). The two sheet elements are formed into the shape of a half-shell, respectively. An injection wall (of the pod) for injecting a fluid into the pod is formed. A substance required for the preparation of the beverage is provided.

Therein, the term "half-shell" may be understood, for example, as a structure that may form one part (half) of the outer casing of the pod. "Substance" may be understood, for example, as any type of (solid, liquid, at least partially soluble and/or percolate-able) matter of a particular or definite chemical constitution. Examples for substances may be instant or roasted ground coffee, tealeaves, syrup or fruit extract concentrate, a chocolate product, dehydrated edible substances, and/or combinations thereof.

The two half-shells are connected to form a pod body around the substance to form the pod.

Thus, the pod may be composed of two pod halves, such as the two half-shells, which are connected (e.g. sealed) to each other to form the pod body. Therein, the connection between the two pod halves may extend within a plane that is sandwiched by the two pod halves. The plane may be a symmetry plane of the pod. In comparison, a capsule for beverage preparation may comprise a capsule body composed by a continuous wall and may comprise at the top (and/or the bottom) of the capsule an opening that is (are) closed by a (substantially flat) membrane, e.g. a lid, (respectively). Hence, as an illustrating example, the shape of a capsule is (primarily) defined by its capsule body while the shape of a pod may be defined once the two half-shells are connected.

The pod body delimits together with the delivery wall and the injection wall a chamber containing the substance for preparing the beverage upon interaction of the substance with the fluid injected through the injection wall.

Therein, "chamber" may be understood, for example, as a (sealingly) enclosed space.

The delivery wall is adapted (configured) to be opened upon interaction with (external) opening elements of the beverage production machine under the effect of rising pressure of the fluid being injected (through the injection wall) into the pod to dispense the prepared beverage from the pod.

Therein, the expression "adapted to be opened" may be understood, for example, as capability, configuration and/or design of the delivery wall to be provided with holes, punctures and/or ruptures, preferably during the beverage preparation process. For instance, the provision of such openings preferably may be subject to certain conditions and/or circumstances, such as the provision of the opening elements and/or excess of a certain pressure inside the pod. This illustrates that a pod, unlike commonly known pads for beverage preparation, facilitates the build-up of pressure inside the chamber that is sufficient to open the delivery wall in the above-specified manner with external opening elements. Typically, said pads are composed of a soft and flexible filter material designed for being perfused but not for building up pressure inside the pad.

The connection area is pinched from opposite sides of the sheet element when forming the respective half-shell.

Therein, the expression "the connection area being pinched" may be understood, for example, as applying a pressure onto at least the radially outer sections of the respective area from two sides and/or compressing the respective area preferably between two opposite (hard in relation to the sheet element or incompressible in relation to the forces existing during the forming process) surfaces.

Thereby, it is possible to make or produce a pod in a process that facilitates that the pod is made from compostable materials while the general layout and all functionalities of a conventional pod can be maintained, which includes the provision of an intact oxygen barrier. Providing individual sections of the pod from different materials that are all supplied as sheets allows to form a strong connection between these materials and to simplify manufacturing. Further, the formability of the sheet elements facilitates to transform the connected sheet materials into a pod with very few limitations on the design of its three-dimensional shape. As described above, a section of the connected sheet material that comprises the bond between the different materials is specifically supported during the forming process through the application of (compressive) forces from two opposite sides. Thus, this section of connected sheet materials can be kept clear from the influence of shearing forces during the forming process. Accordingly, the connection between the materials remains unaffected from the stresses generated in the forming process. Consequently, an oxygen barrier formed with said connection remains intact. Also, the risk of leakages occurring at the connection before or during the beverage preparation can be reduced. Furthermore, there is no further need for modifying material characteristics of the sheet materials through auxiliary measures for the forming process because with the method of the invention the forming process can be completed without risking the integrity of the oxygen barrier. Accordingly, it is possible to use existing equipment and production lines for manufacturing the pod.

Thus, the method of the present invention overcomes the problems of the prior art.

Preferably, the pod may be (home-)compostable.

Therein, the term "compostable" may be understood as meaning that a material may be substantially broken down into organic matter within a few weeks or months when it is composted. This may be accomplished in industrial composting sites and/or home composters. Specific conditions relating to wind, sunlight, drainage and other factors may exist at such sites. At the end of a composting process, the earth may be supplied with nutrients once the material has completely broken down. International standards, such as EU 13432 or US ASTM D6400, provide a legal framework for specifying technical requirements and procedures for determining compostability of a material. For example, one of the tests for compostability requires that—in order to be considered "industrially compostable"—at least 90% of the material in question is to be biologically degraded under controlled conditions within 6 months. Similar tests exist for a certification as home compostable. According to the mentioned standards, all compostable plastic materials must have the following characteristics simultaneously to be considered compostable: the material must be biodegradable and disintegrable, i.e. fragmentation and invisibility in the final compost, and it must not have negative effects on the composting process and quality. Thus, a compostable pod has benefits regarding the disposal of the pod after its use.

According to a preferred embodiment, the sheet elements may be formed into the shape of a half-shell, respectively, by drawing at least part of the respective sheet element into a forming die. Preferably, the respective sheet element may be drawn into the shape of a half-shell by mechanical action of a punch or by the application of vacuum. For example, they may be drawn into the shape of a half-shell by deep drawing the respective sheet elements.

Thereby, the respective parts of the pod can be produced having an even wall thickness. In addition, mechanical stresses peak at the sections of the sheet material that are used to hold the sheet material in the forming die so that it can be avoided to subject the connection area to tensile stress. Moreover, the process of deep-drawing is a consistent and cost-efficient process, which is particularly suitable for continuous manufacturing.

According to a further preferred embodiment, pinching the connection area may be obtained by a punch that may be positioned on one side of the sheet element and a counter-punch that may be positioned on the other side of the sheet element with respect to the punch. Preferably, the punch and the counter-punch may be relatively movable with respect to each other and/or the sheet element. Furthermore, preferably the counter-punch may be configured to dampen and/or to resist a displacement force applied by the punch onto the connection area. Alternatively or additionally, the counter-punch may be elastically supported in the forming die, for example by an elastic element such as a spring. Further, the counter-punch preferably may be spring-elastically biased towards the punch so as to apply a defined clamping force to the connection area during the forming step. This preferably may be the case at least during the forming step.

Thereby, it can be achieved that the connection area is subjected to compressive forces that may reduce or (entirely) compensate tensile stresses occurring during the forming process. Accordingly, the connection area can be kept free from shearing stress. In addition, the above described configuration is particularly suitable for implementing a fast and efficient manufacturing process.

According to a preferred embodiment, each of the two half-shells may comprise a circumferential flange. For example, the circumferential flange may extend radially outward with respect to the respective half-shell. The circumferential flanges may be formed on each of the two half-shells by clamping an area of the respective sheet element between a blank holder surrounding the punch and the forming die when forming the respective sheet element into the shape of a half-shell. Preferably, the two half-shells may be connected to each other via the circumferential flanges.

Thereby, it is possible to maximize the volume of the pod that is usable for receiving the substance as the connection between the two half-shells is provided along their respective perimeter. Furthermore, if a forming die is used, the circumferential flange can be formed as part of the deep-drawing process so that the number of different steps in the manufacturing process of the pod can be reduced.

According to a further preferred embodiment, the two sheet elements may be provided by cutting or punching a sheet that may be made of a formable and/or biodegradable material. Preferably, cutting the opening in the sheet element may be done before, upon or after the two sheet elements are cut or punched from the sheet.

Thereby, the production speed and efficiency can be increased since it is possible to provide the materials on rolls of material that can be rapidly processed.

According to a preferred embodiment, the half-shells may be configured such that the two half-shells may be separated by a gap when surrounding the substance before the step of connecting the two half-shells. Therein, the size of the gap may depend on the volume of the substance. Preferably, at least one of the half-shells may be configured such that the volume of the pod corresponds to the volume of the substance after the step of connecting the two half-shells. Further, the gap may be reduced or eliminated upon connection of the two half-shells.

Alternatively or additionally, a gap is formed at least partially between the substance on the one hand and at least one or both of the half-shells surrounding the substance on the other hand before connecting the two half-shells, when the two half-shells are placed around the substance before connecting the two half-shells. Preferably, the gap may be reduced or eliminated upon connection of the two half-shells.

Preferably, the two half-shells may be connected under the application of vacuum and/or under the application of heat sealing and/or ultrasonic sealing. The half-shells may be sealingly connected via a sealing section extending along the perimeter of each of the half-shells (or preferably along the circumferential flanges, if present).

Preferably, the substance may be provided as a tablet made of compressed beverage powder, preferably coffee powder.

Preferably, at least one of the half-shells (preferably the half-shell comprising the injection wall) may follow in shape and dimension a part of the contour of the tablet to which it is adjacent in the pod before the step of connecting the two half-shells. Alternatively, the substance may be compressed inside one of the half-shells (preferably the half-shell comprising the injection wall) to follow in shape and dimension the contour of the respective half-shell.

Each of the aforementioned configurations facilitates that the substance can be packed tightly inside the pod. For example, the two (formable) half-shells together have a smaller height than the (compacted) substance. Accordingly, when connecting the two half-shells (under vacuum), the substance and/or at least one of the half-shells is adjusted in size to enclose the substance, for example by (further) compressing the substance to the combined volume of the half-shells or bending/elongating/stretching the material of the half-shells using the compacted substance as support surface. Hence, the risk of packaging foreign substances or gas in the pod manufacturing process is reduced. In addition, the beverage preparation process of the so produced pod can be improved because empty spaces, gaps or cavities are eliminated in such processes so that the injected fluid is forced to travel into and through the substance in the intended manner, thereby also leading to the necessary pressure built-up inside the capsule.

According to a further preferred embodiment, the injection wall may be formed when forming one of the half-shells. Preferably, said one half-shell may be the one half-shell other than the half-shell comprising the opening or the delivery wall.

Thereby, the injection wall can be defined on the half-shell that is most suited for the purpose of the application or specifications of the used beverage production machine.

According to a preferred embodiment, forming the injection wall may comprise the step of cutting another opening into one of the sheet elements (which preferably may be the one sheet element other than the sheet element into which the said opening is cut so that the respective sheet element comprises the other opening). The step of forming the injection wall may further comprise the step of covering the other opening with another sheet material and connecting the other sheet material and the respective sheet element at another connection area circumferentially surrounding the other opening, the other so connected sheet material forming the injection wall. Preferably, connecting the other sheet material and the respective sheet element may be accomplished by heat sealing or by ultra-sonic sealing.

According to a further preferred embodiment, the half-shells may be identical.

According to a preferred embodiment, at least one or both of the sheet elements may have a disc shape.

With anyone of these configurations, the pod can be provided with a symmetric layout. This is advantageous as the user does not have to pay attention on how to place the pod in the beverage production machine. In addition, the pod manufacturing process can be simplified since the half-shells of the pod are composed by the identically or at least similarly formed half-shells.

Alternatively, the half-shells may differ in height. The height difference may exist at least before being connected to form the pod body. Preferably, the half-shell comprising the injection wall may have a greater height than the half-shell comprising the delivery wall.

Accordingly, the pod can be produced with a noticeable height difference to indicate the operator an orientation of the pod. Moreover, the different configurations of the half-shells allows to improve filling the half-shell with the substance as the greater height reduces the risk of losing substance during the filling process.

According to a further preferred embodiment, the half-shells may be formed before or after cutting the opening into the sheet element. Alternatively or additionally, the half-shells may be formed before or after cutting or punching the other opening, if present, into the respective sheet element.

Thereby, it can be ensured that the connecting area is not subjected to shearing stress during the forming process so that the integrity of the oxygen barrier is ensured.

A further aspect of the present invention relates to a use of the above-described pod for preparing a beverage in a beverage production machine having a pod holder.

Another aspect of the present invention relates to a pod for preparing a beverage in a beverage production machine, wherein the pod comprises a pod body being composed of two half-shells being connected to each other so as to delimit a chamber for containing a substance for the preparation of the beverage. The pod further comprises an injection wall for injecting a fluid in the chamber for preparing the beverage upon interaction of the fluid with the substance. Also, the pod comprises a delivery wall that is connected to the pod body to close the chamber, the delivery wall being adapted to be opened upon interaction with (external) opening elements under the effect of rising pressure of the fluid being injected into the pod to dispense the prepared beverage from the pod.

Therein, preferably, the pod may be formed without pre-wetting of the paper-based material used for forming the pod body and/or without shearing of a connection area between the pod body and the delivery wall.

The above method and pod facilitates to prepare a beverage with a pod that can be manufactured with compostable materials while retaining all functionalities known from pods established in the prior art. In addition, the pod can be used with already existing beverage preparation machines without the need for modifications. Thus, the pod as well as the beverage preparation method allow to produce a beverage of high quality with a pod that overcomes the problems presently existing with the disposal of prior art pods.

4. BRIEF DESCRIPTION OF DRAWINGS

Further features, advantages and objects of the invention will become apparent for the skilled person when reading the following detailed description of embodiments of the invention and when taking in conjunction with the figures of the enclosed drawings. In case numerals have been omitted from a figure, for example for reasons of clarity, the corresponding features may still be present in the figure.

5. DETAILED DESCRIPTION

Figure 1:
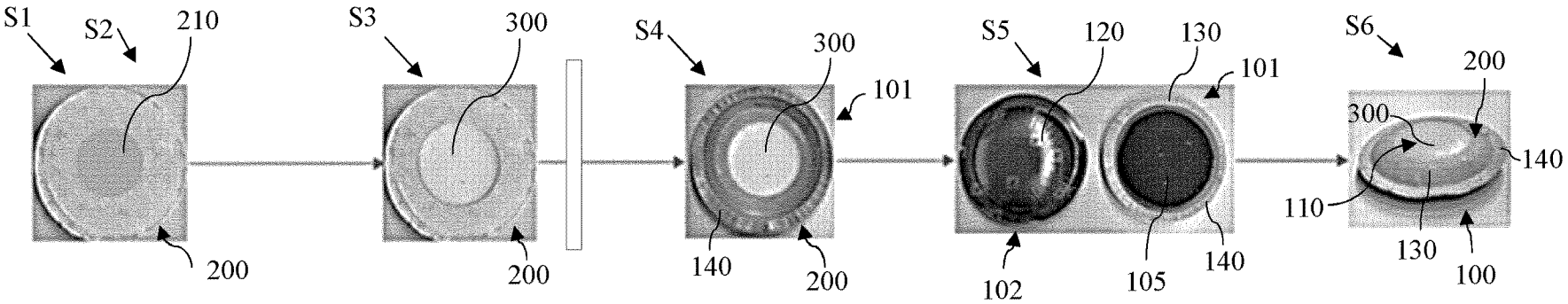
FIG. 1 shows various steps of an embodiment of a pod production method according to the invention.
Figure 2:
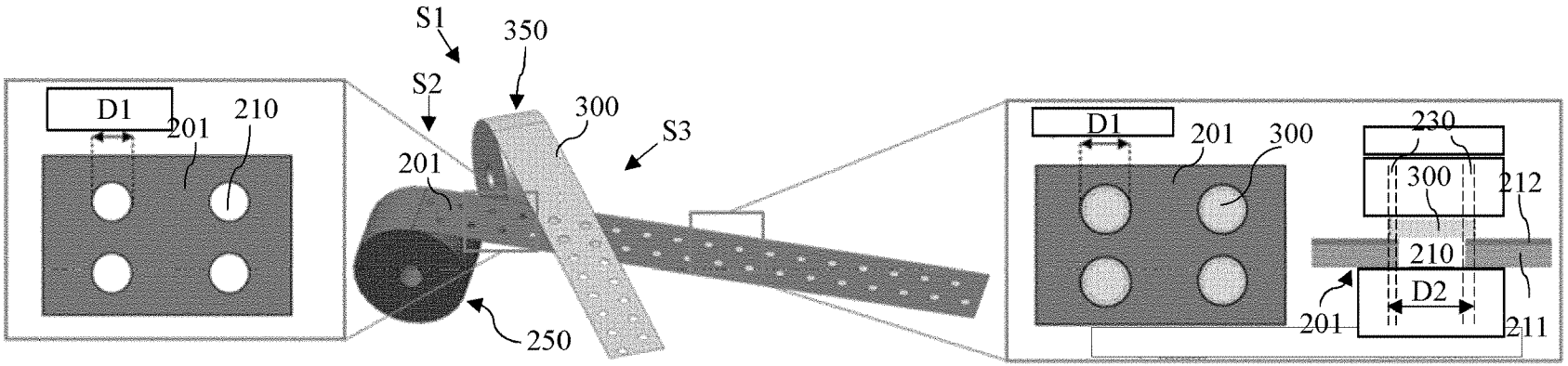
FIG. 2 shows a schematic view of initial steps of an embodiment of the pod production method in the invention.
Figure 3:
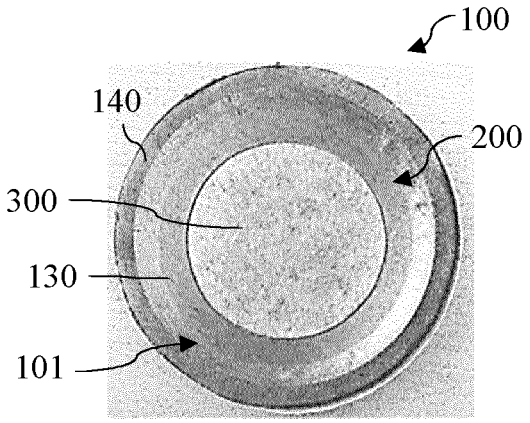
FIG. 3 shows a top view of an embodiment of a pod produced with a pod production method according to the invention.
Figure 4:
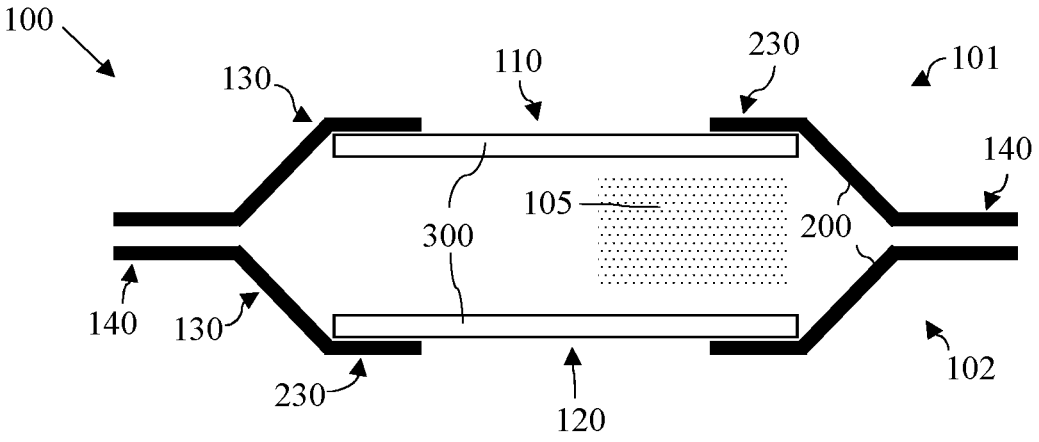
FIG. 4 shows a schematic cross-section of the pod of FIG. 3.
Figure 7A:
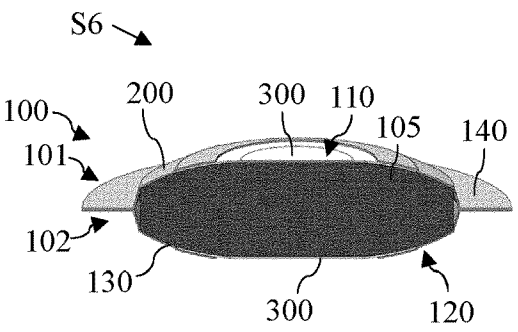
FIGS. 7A and 7B show different embodiments of a connecting step of the pod production method according to the invention.
Figure 7B:
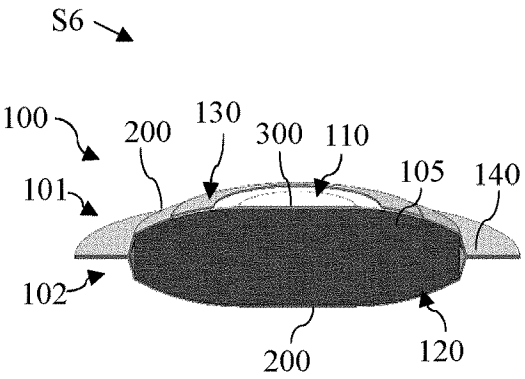
Figure 6A:
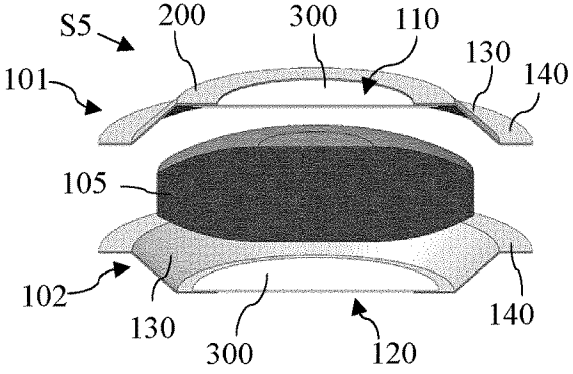
FIGS. 6A and 6B show different embodiments of finalizing steps of the pod production method according to the invention, which include filling and assembly of the pod with a substance for the beverage preparation.
Figure 6B:
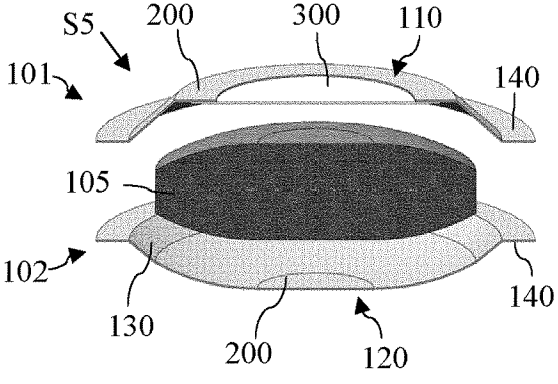

FIGS. 1, 2 and 5 to 7 show different views and aspects of an embodiment of a method for manufacturing a pod 100, which is suitable for preparing a beverage in a beverage production machine, according to the present invention. FIGS. 3 and 4 show different views and aspects of an embodiment of the pod 100 produced with the manufacturing method according to the present invention.

A first aspect of the invention relates to said method for manufacturing a pod for preparing a beverage in a beverage production machine, such as the mentioned pod 100. The method for manufacturing the pod 100 comprises a number of steps, some of which are exemplarily assigned reference signs S1, S2, S3, S4, S5 and S6 in FIG. 1, which are also used in other Figures. It is noted that the invention is not limited to the particular order of steps indicated exemplarily by the reference signs in the Figures. FIGS. 2 and 5 to 7 exemplarily illustrate further details and aspects of steps of the method of the invention.

In the method, two sheet elements 200 are provided. FIGS. 1 and 2 indicate this step exemplarily in step S1. For example, in FIG. 2 it is exemplarily illustrated that the sheet elements 200 may be provided from a sheet 201, which preferably may be provided on a reel 250. Each of the two sheet elements 200 may be provided separately on a reel or they may be provided from the same reel 250. The sheet 201 may be rolled off the reel 250 and (subsequently) may be cut and/or punched to define the sheet elements 200 (e.g. to transform the sheet 201 into the sheet element 200). Cutting and/or punching may be done at various points in the manufacturing process. Naturally, this way of providing the sheet elements 200 is only an example and other ways to provide the sheet elements are conceivable. In particular, FIG. 2 shows exemplarily how a multitude of sheet elements 200 may be provided and produced to industrial scale. Furthermore, as exemplarily shown in FIGS. 1, 3, 4, 6 and 7, at least one or both of the sheet elements 200 may have a disc shape. However, it is also conceivable that the sheet element 200 may have a different shape, such as a rectangular or polygonal shape. Preferably, the shape of the sheet elements 200 may correspond to the shape of the pod holder of the beverage production machine. The sheet elements 200 may have the same shape (as shown in the Figures) or each may have a different shape.

Each of the sheet elements 200 is made of a formable and preferably biodegradable and/or preferably (home-) compostable material. For example, the sheet 201 may be made of a formable and/or biodegradable and/or compostable material. For example, the material of the sheet elements 200 (or the sheet 201) may be formable by being stretchable (and/or deformable permanently) in traverse and longitudinal directions. For example, a suitable material for this purpose may be a formable paper material. The material of the sheet elements 200 (or the sheet 201) may comprise a formable paper material, preferably having a grammage between 80 g/m$^2$ to 150 g/m$^2$. For example, the formable paper material may be a Kraft paper. Preferably, the formable paper material may be exclusively made of cellulose fibres. The material of the sheet elements 200 may have a tensile strength between 2000 MPa and 30 000 MPa, preferably 26 000 MPa in the cross-direction of the paper material, and/or preferably 2600 MPa in the machine-direction of the paper material. Preferably, the sheet elements 200 may be configured to have an elongation at break in the range between 8% and 15% at a tensile strength between 2000 MPa to 40 000 MPa. Therein, elongation at break may generally be understood as the ratio between changed length and initial length after breakage of the test specimen, and can be used as a measure to quantify the resistance of a material to changes of the shape without breaking or crack formation. For example, the elongation at break can be determined by tensile testing following EN ISO 527. The work up to break of the material of the sheet elements 200 may be between 100 Nmm and 200 Nmm. For example, by providing the sheet elements 200 (or the sheet 201) with any of the aforementioned configurations, it is possible to provide the pod 100 with sufficient rigidity, stiffness and/or form-stability to build up pressure inside the pod 100 during the preparation of a beverage.

Preferably, the material of the sheet elements 200 may have a (laminated) multi-layer structure, which preferably may comprise at least one additional layer 212 (in addition to a formable paper layer 211). This exemplarily illustrated in the schematic cross-section of FIG. 2. Preferably, the material of the sheet elements 200 may comprise an oxygen-barrier and/or moisture barrier and/or adhesive layer that may be provided as a coating and/or in a lamination process. For example, the oxygen barrier may be lower than 5 cc/m$^2$-day.

Further, in the method, an opening 210 is cut (and/or punched) into at least one of the sheet elements 200. This is exemplarily shown in step S2 of FIGS. 1 and 2. It is conceivable that the opening 210 may be cut in the sheet element 200 before (FIGS. 2 and 5), upon (FIG. 1) or after the two sheet elements 200 are cut or punched from the sheet 201. The opening 210 may have any shape and/or size. Preferably, the opening 210 may be circular and/or may be a through hole. The diameter D1 of the opening 210 may be between 18 mm and 30 mm, preferably 24 mm. FIG. 2 shows this exemplarily. Preferably, the sheet element 200 may comprise one or more (similar and/or different) openings. Generally, there is no limitation in the number of openings 210 the sheet elements 200 may have. Preferably, the opening 210 may be configured and/or provided/arranged such that elements of the beverage production machine, like opening elements and/or injection elements, do not engage and/or come into contact with the remaining parts of the sheet element 200 in the beverage production machine during the beverage preparation. This may be achieved by dimensioning and/or positioning the opening 210 accordingly.

Moreover, in the method, the opening 210 is covered with a sheet material 300. FIG. 2 exemplarily illustrates in step S3 that the sheet material 300 may be placed over the opening 210. Preferably, the opening 210 may be fully closed (on one side of the sheet element 200) by covering the opening 210, as exemplarily illustrated in FIGS. 1 to 7.

The sheet material 300 and the respective sheet element 200 (having the opening 210) are connected at a connection area 230. The connection may be established by sealing the respective elements to each other, for example by heat sealing or ultrasonic sealing. The state, in which the sheet element 200 (or sheet 201) is connected to the sheet material 300, is exemplarily shown in all Figures. FIGS. 1 and 2 indicate this part of the manufacturing process as step S3. The connection area 230 circumferentially surrounds the opening 210. Thus, the connection area 230 may be a section of the sheet element 200 that is situated at the opening 210, encloses the opening 210 and/or directly adjoins (is contiguous with) the opening 210. For example, in FIG. 2 the connection area 230 is exemplarily illustrated as a ring shaped (continuous) section of the sheet 201 (or the sheet element 200). Preferably, the connection area 230 may be circular and have a diameter D2 (FIG. 2). The diameter D2 may be between 15 mm and 40 mm, preferably 32 mm. However, the connection area 230 may have any size or shape that preferably may correspond with and extend over the shape and size of the opening 210. The sheet material 300 may be connected to either side of the sheet element 200.

Preferably, the sheet material 300 may have any size, shape or form. For, example, in FIG. 2 it is exemplarily illustrated that the sheet material 300 may be provided as a sheet rolled onto a reel 350. The sheet material 300 may be rolled off the reel 350 such that the sheet material 300 intersects with the sheet 201 and thereby covers the opening (s) 210 provided in the sheet 201. Therein, it is (alternatively or additionally) conceivable that in step S3 the sheet material 300 may be adjusted to take a different shape and size, before, upon or after the sheet material 300 and the sheet element 200 are connected at the connection area 230. This is irrespective of the provision of the sheet material 300 as a sheet rolled onto a reel 350. FIG. 2 (right of the intersection of the sheet material 300 and the sheet 201) and FIG. 5, for example, show the sheet material 300 being adjusted to the size of the connection area 230. In FIG. 2, the size adjustment is exemplarily illustrated as being accomplished during the connection process of the sheet material 300 and the sheet 201. However, this is only an example and not to be understood as the only possible implementation of step S3.

The so connected (sealed) sheet material 300 forms a delivery wall 110 of the pod 100. Through the delivery wall 110 the beverage is dispensed from the pod 100 during the process of preparing the beverage. The delivery wall 110 is exemplarily shown in all Figures, but highlighted in FIGS. 1 and 3 to 7. The delivery wall 110 is adapted to be opened upon interaction with opening elements (e.g. pyramid plate) of the beverage production machine (i.e. opening elements external to the pod 100) under the effect of rising pressure of the fluid being injected into the pod 100 to dispense the beverage from the pod 100.

The sheet material 300 may be provided as a continuous foil, film, sheet or membrane or as a layered structure. Preferably, the sheet material 300 may be a biodegradable and/or (home-) compostable material. For example, the sheet material 300 may comprise a paper material, preferably having a grammage between 20 g/m$^2$ and 100 g/m$^2$ and/or more preferred comprising an aerated structure to provide softness to facilitate the sheet material's 300 perforation. Moreover, the sheet material 300 may comprise paper, parchment paper, (coated) cellophane, a (home- or industrial-) compostable film and/or a filter paper for filtering particles and residues of the substance from the prepared beverage. Alternatively or additionally, the sheet material 300 may comprise an oxygen barrier (e.g. less than 5 cc/m$^2$-day) and/or moisture barrier. Preferably, the sheet material 300 may be configured to have an elongation at break in the range between 2% and 25% at a tensile strength between 250 MPa to 15 000 MPa.

Figure 5:
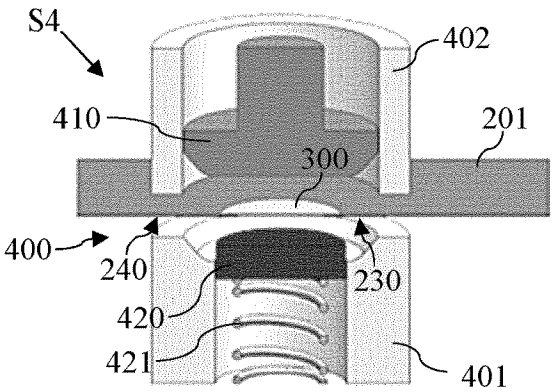
FIG. 5 shows a schematic view of an embodiment of a forming step in the pod production method according to the invention.

The two sheet elements 200 are formed into the shape of a half-shell 101, 102, respectively, as exemplarily shown in step S4 of FIGS. 1 and 5. This may be done before or after (FIGS. 1 and 5) cutting the opening 210 into the sheet element 200. The forming of the sheet elements 200 into the shape of a half-shell 101, 102 may be accomplished by (deep-)drawing the respective sheet element 200 into a forming die 400, for instance. Therein, the forming die 400 may comprise a blank holder 402 to keep the sheet 201 (sheet element 200) during the forming step S4 in a fixed position. The forming die 400 may further comprise a forming part 401 that corresponds with the (negative) shape of the finished half-shell 101, 102. Preferably, the sheet 201 or sheet element 200 may be drawn into the shape of a half-shell by mechanical action of a punch 410 or by creating a pressure difference between the forming part 401 and the side opposite thereto with respect to the sheet 201 (sheet element 200). For example, overpressure or a vacuum may be applied. The punch 410 may have any shape. Preferably, the punch 410 may have a shape that corresponds with the shape of the forming part 401. This is exemplarily illustrated in FIG. 5.

The half-shells 101, 102 may have any shape or form. Preferably, the shape of the half-shells 101, 102 may correspond with the geometry of the pod holder. Examples for the geometry and design of the half-shells 101, 102 can be taken from FIGS. 1 and 3 to 7. In these Figures, it is exemplarily illustrated that each of the two half-shells 101, 102 may comprise a circumferential flange 140, which may extend radially outward with respect to the respective half-shell 101, 102. Further, each of the half-shells 101, 102 may extend axially from an inner edge of the circumferential flange 140 towards the opening 210 (if present). The circumferential flanges 140 may be formed on each of the two half-shells 101, 102 as part of the half-shell forming process. For example, the circumferential flanges 140 may be formed by clamping a, with respect to the opening 210, radially outer area 240 of the respective sheet element 200 (or of the sheet 201) between the blank holder 402 surrounding the punch 410 and the forming die 400. In addition, the blank holder 402 may comprise a sharp edge that cuts through the sheet 201 to separate the half-shell 101, 102 from the sheet 201 (e.g. thereby preferably finishing the sheet element 200). The half-shells 101, 102 may be identical or different to each other. For example, the half-shells 101, 102 may differ in height. Moreover, the half-shells 101, 102 may be different in so far as that one of the half-shells 101, 102 comprises the opening 210 and the sheet material 300 being connected to it while the respective other of the half-shells 102, 101 does not comprise the opening 210 or its opening 210 is covered by a material different to the sheet material 300. FIGS. 6 and 7 illustrate examples for such differently designed half-shells 101, 102.

However, as exemplified by the Figures, before being formed into the shape of a half-shell, at least one of the sheet elements 200 (or at least one section of the sheet 201) may have a configuration where the opening 210 may be covered by the sheet material 300 and where the sheet element 200 (or at least one section of the sheet 201) and the sheet material 300 may be connected to each other.

The connection area 230 is pinched from opposite sides of the sheet element 200 when forming the respective half-shell 101, 102. Preferably, pinching the connection area 230 may be obtained by the aforementioned punch 410 being positioned on one side of the sheet element 200 and a counter-punch 420 being positioned on the other side of the sheet element 200 with respect to the punch 410. The punch 410 and the counter-punch 420 may be relatively movable with respect to each other and/or the sheet element 200 (sheet 201). This is exemplarily illustrated in FIG. 5. The counter-punch 420 may be configured to dampen and/or to resist a displacement force applied by the punch 410 onto the connection area 230. The counter-punch 420 may be elastically supported in the forming die 400, preferably by an elastic element 421, like a spring. Naturally, other implementations of the elastic element 421 are conceivable, such as a hydraulic spring, an air spring or an electrically driven and controlled piston. Generally, any element capable of being reversibly displaceable in reaction to a machine force typical for the forming process may be considered for the elastic element 421. The counter-punch 420 may be preferably elastically (or spring-elastically) biased towards the punch 410. Thereby, a defined pinching force is applied onto the connection area 230 through the compressive action of the punch 410 onto counter-punch 420 during the forming step.

An injection wall 120 of the pod 100 for injecting a fluid into the pod 100 is formed. The injection wall 120 may interact or engage with injection elements of the beverage production machine during the beverage preparation process, through which a (hot, e.g. 60 to 120 degree Celsius) fluid (under pressure, e.g. 1 to 20 bar) may be injected into the pod 100. The injection wall 120 may be formed when forming one of the half-shells 101, 102 and preferably may be the one half-shell 101, 102 other than the half-shell 101, 102 comprising the opening 210 or the delivery wall 110. This is exemplarily shown in FIGS. 1 and 3 to 7. For example, the injection wall 120 may be identical to the delivery wall 110 as exemplarily illustrated in FIGS. 6A and 7A. For this, the injection wall 120 may be formed by cutting another opening into the sheet element 200, which preferably is the sheet element 200 other than the sheet element 200 into which the said opening 210 is cut, so that the respective sheet element 200 comprises the other opening. Then, this other opening may be covered with another sheet material, which then may be connected with the respective sheet element 200, preferably by heat sealing or ultrasonic sealing, at another connection area circumferentially surrounding the other opening. Thereby, the other so connected (sealed) sheet material may form the injection wall 120. The other opening may be cut/punched into the respective sheet element 200 before or after the half-shells 101, 102 are formed. The other sheet material may be the same or different to the sheet material 300. However, it is also conceivable that the other opening may be provided in the same sheet element 200, which comprises already the said opening 210. Alternatively, the injection wall 120 may be formed by the half-shell 101, 102 that does not comprise the opening 210 and may consist of the material of the sheet element 200. Thus, the injection wall 120 may be defined as a wall portion of the half-shell 101, 102 in such configuration. This is exemplarily shown in FIGS. 6B, 7B.

A substance 105 required for the preparation of the beverage is provided. This is exemplarily illustrated in FIGS. 1 and 6 as step S5. For example, the substance 105 may be provided as a tablet made of compressed or compacted beverage powder, such as coffee powder. In general, the substance may be an (extractable) food substance, such as ground coffee powder, tea or chocolate. It is also conceivable to compact the substance 105 in one of the half-shells 101, 102 as part of step S5. Preferably, the half-shell 101, 102 forming the injection wall 120 or more preferred, the one half-shell 101, 102 without the opening 210 may be used for this purpose. This is exemplarily illustrated in FIG. 6B.

The two half-shells 101, 102 are connected. By connecting the two half-shells 101, 102 they form a pod body 130 around the substance 105 to form the pod 100. The pod body 130 together with the delivery wall 110 and the injection wall 120 delimit a chamber containing the substance 105 for preparing the beverage upon interaction of the substance 105 with the fluid injected through the injection wall 120. This is exemplarily shown in FIGS. 1 and 7 as step S6. The connection of the two half-shells 101, 102 may be established under the application of vacuum and/or under the application of heat sealing and/or ultrasonic sealing and/or pressure. Thereby, the half-shells 101, 102 may be sealingly connected via a sealing section that extends along the perimeter of each of the half-shells 101, 102. For example, in the FIGS. 1 to 4 and 7, the two half-shells 101, 102 are illustrated as being connected to each other via the circumferential flanges 140. Thus, the circumferential flanges 140 may form the sealing section. For example, for the connection process, the two half-shells 101, 102 and/or the substance 105 may be concentrically aligned and/or may be brought into abutment, preferably such that the substance 105 is sandwiched between the two half-shells 101, 102.

It has been surprisingly been found that it is also possible to configure the half-shells 101, 102 such that—at first—the two half-shells 101, 102 are separated (radially and/or axially) by a gap when surrounding the substance 105 before the step of connecting the two half-shells 101, 102. Therein, the size of the gap may depend on the volume of the substance 105. However, the half-shells 101, 102 may be configured such that the volume of the pod 100 corresponds to the volume of the substance 105 after the step of connecting the two half-shells 101, 102 so that the gap may be reduced or even eliminated upon connection of the two half-shells 101, 102. This may be a result of the pod manufacturing method of the invention comprising the step of pinching the connection area 230 since the material forming the pod body 130 is primarily stretched at portions thereof that are between the flange 140 and the opening 230. In comparison, the connection area 230 and delivery wall 110 have not undergone mechanical stress and thus, higher forces are required to stretch and plastically deform this section of the pod 100. Thereby, it is possible that the two half-shells 101, 102 stretch to match the volume and dimensions of the substance 105 under conditions typically present during the filling and connection process, which include the application of a vacuum during the connecting process. This effect may be advantageously supported by the substance 105 being compacted as it may act as a bending edge for stretching the half-shells 101, 102. In experiments, a gap extending up to 2 mm, preferably between 0.1 mm and 2 mm, was successfully reduced or even eliminated at the end of the connecting process. Therein, the configuration of the half-shells 101, 102, the substance 105 and/or the connection process may be such that at least one of the half-shells 101, 102, preferably the half-shell 101, 102 comprising the injection wall 120, may follow in shape and dimension at least a part of the contour of the compacted substance 105, to which it is adjacent in the pod 100. It is also conceivable that, before the step of connecting the two half-shells 101, 102, the half-shells 101, 102 may be formed such that they differ in height. Preferably, the half-shell 101, 102 comprising the injection wall 120 may have a greater height than the half-shell 101, 102 comprising the delivery wall 110. Naturally, it is also conceivable that no gap (0 mm) exists between the two half-shells 101, 102 at the beginning of the connecting process. In this configuration, the substance 105 may be (additionally) compacted during the connecting process.

A further aspect of the present invention relates to a pod, such as the above described pod 100, being produced in the above described method. The pod 100 is suitable and/or configured for preparing a beverage in a beverage production machine. The beverage production machine may comprise elements for opening the pod 100 under the effect of rising pressure of a fluid that is injected into the pod 100. FIGS. 1, 3, 4 and 7 show examples of the pod 100. The pod 100 may be made (entirely) from (home-)compostable materials so that the pod 100 may be simply disposed in industrial or home compost piles after its use. Thus, the entire contents of the pod 100, including any beverage components contained therein, may be compostable. The pod 100 comprises the pod body 130 being composed of the two half-shells 101, 102 being connected to each other so as to delimit a chamber for containing the substance 105 for the preparation of the beverage. Further, the pod 100 comprises an injection wall 120 for injecting a fluid in the chamber for preparing the beverage upon interaction of the fluid with the substance 105. Moreover, the pod 100 comprises a delivery wall 110 being connected to the pod body 130 via the connection area 230 to close the chamber, the delivery wall 110 being adapted to be opened upon interaction with (external) opening elements under the effect of rising pressure of the fluid being injected into the pod 100 to dispense the prepared beverage from the pod 100. Preferably, the pod 100 contains the substance 105. Preferably, the connection between the delivery wall 110 and the pod body 130 may be free of stresses due to shearing forces during the forming process of the half-shells 101, 102. More preferred, the forming process of the half-shells 101, 102 may be accomplished without pre-wetting of the formable material used for the pod body 130.

A further aspect of the present invention relates to a use of a pod, such as the above described pod 100, which is produced in the above described method, for preparing a beverage in a beverage production machine having a pod holder. Therein, the pod 100 may be placed inside the pod holder of the beverage production machine. The pod holder may be closed and the beverage may be prepared in the above-described way and may be released from the pod 100 by interaction of the delivery wall 110 with the opening elements of the beverage production machine.

The invention is not limited by the embodiments as described hereinabove, as long as being covered by the appended claims. All the features of the embodiments described hereinabove can be combined in any possible way and be provided interchangeably.

The invention claimed is:

1. A method for manufacturing a pod for preparing a beverage in a beverage production machine, the method comprising the steps of:

providing two sheet elements each being made of a formable material;

cutting an opening into one of the two sheet elements;

covering the opening with a sheet material and connecting the sheet material and the one of the two sheet elements at a connection area circumferentially surrounding the opening, the so connected sheet material forming a delivery wall;

forming each of the two sheet elements into a respective half-shell to form two half-shells;

forming an injection wall of the pod for injecting a fluid into the pod;

providing a substance required for the preparation of the beverage; and connecting the two half-shells to form a pod body around the substance to form the pod, the pod body together with the delivery wall and the injection wall defining a chamber containing the substance for preparing the beverage upon interaction of the substance with the fluid injected through the injection wall, and the delivery wall being adapted to be opened upon interaction with opening elements of the beverage production machine under the effect of rising pressure of the fluid being injected into the pod to dispense the beverage from the pod, wherein the connection area is pinched from opposite sides of the one of the two sheet elements when forming the respective half-shell from the one of the two sheet elements.

2. The method according to claim 1, wherein each of the two sheet elements is formed into the respective half-shell by drawing at least part of each of the two sheet elements into a forming die.

3. The method according to claim 1, wherein the pinching of the connection area is performed by a punch positioned on one side of the one of the two sheet elements and a counter-punch positioned on an opposite side of the one of the two sheet elements with respect to the punch.

4. The method according to claim 3, wherein the counter-punch is configured to dampen and/or to resist a displacement force applied by the punch onto the connection area, and the counter-punch is elastically supported in a forming die.

5. The method according to claim 3, wherein the counter-punch is spring-elastically biased towards the punch so as to apply a defined clamping force to the connection area during the step of forming each of the two sheet elements.

6. The method according to claim 1, wherein each of the two half-shells comprises a circumferential flange.

7. The method according to claim 6, wherein the two half-shells are connected to each other via the circumferential flanges.

8. The method according to claim 1, wherein the two sheet elements are provided by cutting or punching a sheet made of a formable and biodegradable material.

9. The method according to claim 1, wherein the two half-shells are configured such that the two half-shells are separated by a gap when surrounding the substance before the step of connecting the two half-shells.

10. The method according to claim 1, wherein the injection wall is formed when forming one of the half-shells.

11. The method according to claim 1, wherein the two half-shells are formed before or after cutting the opening into the one of the two sheet elements.

12. The method according to claim 1, wherein at least one of the two sheet elements have a disc shape.

13. The method according to claim 1, wherein the two half-shells are identical.

14. The method according to claim 1, wherein the substance is provided as a tablet made of compressed beverage powder.

15. The method according to claim 1, wherein the two half-shells are connected under application of vacuum and under application of heat sealing or ultrasonic sealing.

16. The method according to claim 4, wherein the counter-punch is elastically supported in the forming die by an elastic element.

17. The method according to claim 16, wherein the elastic element is a spring.

* * * * *